United States Patent [19]

Salavin et al.

[11] Patent Number: 5,030,888

[45] Date of Patent: Jul. 9, 1991

[54] VERY FAST METHOD OF CONTROL BY SEMI-SELECTIVE AND SELECTIVE ADDRESSING OF A COPOLANAR SUSTAINING AC TYPE OF PLASMA PANEL

[75] Inventors: Serge Salavin, Saint Egreve; Jacques Deschamps, Grenoble; Michel Gay, Le Fontanti; Bruno Rimaud, Saint Egreve; Michel Specty, Echirolles, all of France

[73] Assignees: Thomson-CSF, Puteaux, France

[21] Appl. No.: 396,638

[22] Filed: Aug. 22, 1989

[30] Foreign Application Priority Data

Aug. 26, 1988 [FR] France ..... 88 11248

[51] Int. Cl.[5] ..... G09G 3/10; G09G 3/22

[52] U.S. Cl. ..... 315/169.4; 315/169.1; 340/771; 340/805

[58] Field of Search ..... 315/169.4, 169.1; 340/805, 771, 772, 775, 776, 777, 813; 313/585, 584

[56] References Cited

U.S. PATENT DOCUMENTS 4,737,687 4/1988 Shinoda et al. ..... 315/169.4
4,866,349 9/1989 Weber et al. ..... 315/169.4
4,914,352 4/1990 Gay et al. ..... 315/169.4
4,924,218 5/1990 Weber et al. ..... 315/169.4 X

FOREIGN PATENT DOCUMENTS 0135382 3/1985 European Pat. Off. .
0149381 7/1985 European Pat. Off. .
0193646 9/1986 European Pat. Off. .
0266462 5/1988 European Pat. Off. .

*Primary Examiner*—Eugene P. LaRoche
*Assistant Examiner*—Ali Neyzari
*Attorney, Agent, or Firm*—Oblon, Spivak, McClelland, Maier & Neustadt; Oblon, Spivak, McClelland, et al.

[57] ABSTRACT

Disclosed is a method for the control of the pixels of a plasma panel by selective addressing and semi-selective addressing. The disclosed method can be applied to cases where a pixel is defined at the intersection of a column electrode with a pair of sustaining electrodes. The disclosed method can be used, notably, to obtain a reduced picture cycle time. To this effect, according to one characteristic of the disclosed method, certain pixels are controlled simultaneously by semi-selective addressing while other pixels are controlled by selective addressing.

12 Claims, 4 Drawing Sheets a
T
T1
T2
ΔCBe
t1
t5
t6
t7
t8
t1'
+VY3
CI
t2
t3
+VY2
CBi
IE
+VY1
VYØ1
VR
(A)
CBe
-VY1
ΔIE
ΔCI
b
+VE1
VEØ1
VR
-VE1
c
ΔØ1
T
+VY3
CI
CBe
+VY2
+VY1
VYØ2
VR
(B)
CBi
-VY1
T2
T1
Δt
d
ΔM
VX
MX1 à MX4
VV
e
T1
T
+VY3
IE
CI
+VY2
CBe
CBi
+VY1
VYØ3
VR
(C)
-VY1
ΔØ2
ΔØ1
f
+VE1
VEØ2
VR
-VE1
g
T2
+VY3
T1
T
CI
VYØ4
+VY2
IE
CBi
CBe
(D)
+VY1
VR
-VY1

VERY FAST METHOD OF CONTROL BY SEMI-SELECTIVE AND SELECTIVE ADDRESSING OF A COPLANAR SUSTAINING AC TYPE OF PLASMA PANEL

BACKGROUND OF THE INVENTION

1. Field of the Invention

The present invention concerns a method for the control of the pixels of a plasma panel by means of semi-selective and selective addressing phases. The invention can be applied to AC type panels with coplanar sustaining, particularly of the type wherein each elementary picture element is defined substantially at the intersection of an addressing electrode, called a column electrode, with two other parallel electrodes forming a pair of sustaining electrodes.

2. Description of the Prior Art

Plasma panels are flat panel or screen display devices that enable the display of alphanumerical, graphic or other images, in color or otherwise. These panels work on the principle of an emission of light produced by an electrical discharge in a gas.

Generally, plasma panels comprise two insulating plates bounding a volume occupied by a gas (generally a neon-based mixture). These plates support conductive electrodes intersecting so as to form a matrix of cells each forming a picture element or pixel. An electrical discharge in the gas, causing an emission of light at a cell or pixel, takes place when the electrodes of this pixel are suitably excited.

Although certain plasma panels work in DC mode, it is most commonly preferred to use AC type panels, the working of which is based on an excitation of the electrodes in AC mode. The electrodes are coated with a layer of dielectric material They are therefore no longer in direct contact either with the gas or with the discharge.

The working of an AC type plasma panel with two intersecting electrodes to define a pixel is known, notably from a French patent No. 7,804,893, filed on behalf of THOMSON-CSF and published under No. 2,417,848.

With a view, notably, to improving the luminance of the plasma panels and also to enabling the display of several colors, it is preferred to use plasma panels of the type excited in AC mode as mentioned above but which, in addition, have coplanar sustaining.

In panels of this latter type, called coplanar sustaining plasma panels, each pixel of the matrix is formed by three electrodes, more precisely at the intersection between an addressing electrode, called a column electrode, and two parallel sustaining electrodes forming a pair of sustaining electrodes. With this type of panel, it is known that the sustaining of the discharges is done between the two sustaining electrodes of one and the same pair, and that the addressing is done by the generation of discharges between two intersecting electrodes.

The sustaining electrodes form two classes: the electrodes of a first class are called "addressing-sustaining" electrodes, while the electrodes of a second class are called "solely sustaining electrodes". The function of the addressing-sustaining electrodes is, firstly, in cooperation with the solely sustaining electrodes, to achieve the sustaining discharges and, secondly, to fulfill an addressing role. Consequently, they are individualized, that is, they are connected to one or more pulse generating devices through means that enable one or more particular pulses, called addressing pulses, to be applied to only one or to more addressing-sustaining electrodes which are selected from among the plurality of addressing-sustaining electrodes.

The solely sustaining electrodes (of the second class) are generally connected to one or more pulse generators in such a way that these solely sustaining electrodes are all, at the same instants, carried to the same potentials, so that they do not need to be individualized and may, if necessary, be connected to one another.

The term "addressing" refers to the signals applied to the electrodes of one or more pixels selected from among the plurality of pixels, in order to obtain their writing (lighting up) and/or their erasure (extinguishing). This is by contrast with the sustaining signals which are applied, without distinction, to the electrodes of all the pairs of sustaining electrodes in order to provoke sustaining discharges (light emission) by all the pixels which are in the written state.

The addressing may be selective or semi-selective:

the addressing is selective when it determines either the writing or the erasure of one or more selected pixels, without modifying the state of the other pixels belonging to a same line-up as the pixel or pixels selected (a line-up of pixels may be formed either in the direction of a row of pixels, that is, parallel to the pairs of electrodes, or in a direction perpendicular to the rows, that is, parallel to the column electrodes.

the addressing is semi-selective when it either writes or erases, simultaneously, an entire line or line-up of pixels (the line-up may be parallel to the pairs of electrodes or parallel to the column electrodes). It must be noted that should a control method include a semi-selective addressing phase (either for a writing operation or for an erasing operation) this first semi-selective addressing phase is generally followed by a selective addressing phase (which achieves the opposite operation).

Among the advantages provided by the structures where the pixel is defined at the intersection of a column electrode with a pair of sustaining electrodes, we might cite greater luminance. This is due notably to the fact that the sustaining discharges (which are those giving the essential part of the light) between the two sustaining electrodes, occur on a surface that goes beyond the surface of intersection with the column electrode. This means that the useful light is not blocked by this column electrode which is generally mounted on the side with the plate by which the plasma panel is looked at.

It must be noted that the addressing/sustaining electrodes and solely sustaining electrodes each have, at each pixel, a protuberance or projecting surface. In one and the same pair of sustaining electrodes, the projecting surfaces of one electrode are pointed towards the projecting surfaces of the other electrode, and the sustaining discharges occur between these projecting surfaces.

A plasma panel such as this is known notably from the European patent document EP-A-O 135 382 which also describes a method for the control of this panel. It must be noted that, in the device described in this European patent, the column electrode intersects the pairs of sustaining electrodes on the side of the projecting surfaces where the sustaining discharges are produced.

Another structure of the type wherein each pixel is defined at the intersection of a column electrode with a pair of sustaining electrodes, as well as an adapted control method, are described in the article by G. W. DICK in PROCEEDINGS OF THE SID, vol 27/3, 1986, pages 183–187. It must be noted that, in the structure described in this document, the sustaining electrodes have a constant width, that is, they have no facing, projecting surfaces in a pair of sustaining electrodes, to define the sustaining discharge zone. By contrast, this structure has barriers made of an insulating material. These barriers serve to confine sustaining discharges in the zone of intersection with the column electrode.

Another type of plasma panel, to which the method of the invention can be applied in a particularly worthwhile way, is shown in FIG. 1. A panel of this type is the object, in itself, of a French patent application No. 88 03953 filed on Mar. 25, 1988 on behalf of THOMSON-CSF. Since this French patent application has not been published to date, the new type of plasma panel to which it refers is described hereinafter.

The panel shown in FIG. 1 has a first glass plate 10 covered with a first class of electrodes marked Xj where j is a whole number ranging from 1 to N (only one electrode Xj is shown; the set formed by the plate 10 and the electrode Xj is coated with a layer 12 of dielectric material, which may be covered with a layer of oxide such as MgO (not shown). On the dielectric layer 12, there is a patch 14 of a luminophor material, namely a material capable of emitting a colored radiation under the effect of an ultra-violet radiation.

The panel further has a second glass plate 20 coated with a second class of electrodes formed by pairs of electrodes, respectively called sustaining-addressing electrodes (Yae)i and sustaining electrodes (Ye) where i is a whole number in the range of 1 to P. The sustaining-addressing and sustaining electrodes include protuberances or projecting surfaces 22 and 24, placed so as to face each other. The unit formed by the plate 20 and the electrodes is coated with a dielectric layer 26.

In normal operation, the two plates 10 and 20 and their networks of electrodes are brought close together and kept apart by a shim (not shown), and there is a gas present in the volume between the plates and the shim. Once the panel is mounted, it thus has two networks of orthogonal electrodes, in the sense that the electrodes Xj are orthogonal to the electrodes (Yae)i and (Ye). The electrodes Xj may overlap the protuberances 22 and 24, or may be slightly offset on their side. A pixel Pij is then defined by an electrode Xj (a column electrode) and a pair of sustaining electrodes (Yae)i and (Ye).

If the above-described plasma panel or other coplanar sustaining AC type plasma panels, such as, for example, the panels described earlier, are controlled by a known control method, it is observed, notably, that the working of these panels is too limited as regards the speed with which an image can be renewed, to be capable of being used as a so-called "all options" display panel, namely to display an image with a sufficient number of half-tones or gradual ranges of colors. For, especially with the making of color panels, it becomes very important to have a large number of half-tones (128 for example) to make a good picture (of the television cathode-ray tube picture type) on a plasma panel with a number of rows of pixels at least equal to 512.

The time needed to form a picture depends on the number of pixels and on the time needed for the erasure addressing, writing addressing and sustaining operations.

To reduce the time needed to form a picture, it is sought to reduce the total addressing time. To this effect, the prior art method consists in doing a semi-selective addressing (either for erasure or for writing, and in rows or columns) followed by a selective addressing.

Thus, for example, assuming that the semi-selective addressing concerns the erasing operation and is done according to rows of pixels, a basic cycle or cycle period per line generally comprises:

- a semi-selective addressing phase during which an entire row of pixels is erased;
- the semi-selective addressing phase is followed by a stabilization phase (optional);
- then, a selective addressing phase, during which only the selected pixel or pixels are written;
- then, a specific sustaining phase.

To each of these phases, there corresponds a particular combination of voltages developed among the three electrodes that form a pixel, following the application to one or more of these electrodes of positive or negative pulses forming sets of cyclical pulses.

This is repeated for each line of pixels.

It would seem that, at present, the minimum period that may be expected for a basic cycle as defined above is of the order of 20 microseconds.

Thus, in the case, for example, of a plasma panel with 512×512 pixels, if the image is renewed at 50HZ, only four half-shades are possible, in view of the method used for the control of the half-shades.

SUMMARY OF THE INVENTION

The invention concerns a method for the control of a coplanar sustaining AC plasma panel, each pixel of which comprises three electrodes. This method of control is of the type with semi-selective addressing, followed by a selective addressing, and its chief purpose is to enable the reduction, overall, of the addressing time, so as to permit, notably, a greater number of half-shades or, again, a greater number of pixels.

According to the invention, there is proposed a method for the control of a coplanar sustaining AC plasma panel, said panel comprising column electrodes intersecting with two classes of parallel electrodes, the first class of electrodes being formed by addressing-sustaining electrodes and the second class being formed by solely sustaining electrodes, each addressing-sustaining electrode forming, with a neighboring solely sustaining electrode, a pair of sustaining electrodes, each pair of electrodes corresponding to a row of pixels perpendicular to the column electrodes, the pixels being formed substantially at each intersection of a column electrode with a pair of electrodes, said method consisting in the application of a first set of pulses of cyclical voltages to all the addressing-sustaining electrodes and in applying a second set of pulses of cyclical voltages to all the solely sustaining electrodes, the two sets of voltage pulses having a same period within which said pulses of voltages develop, between the electrodes of each pixel, voltage differences which firstly, in a first time interval, create a semi-selective addressing phase and, in a second time interval, create a selective addressing phase and, secondly, generate sustaining discharges, a method wherein, simultaneously, certain pixels are controlled by semi-selective addressing and other pixels are controlled by selective addressing.

By this method, the time needed for the complete control (erasure and/or writing) of a row or column of pixels remains unchanged. However, during this very same time,, it is possible to fully control at least two rows or columns of pixels so that the picture forming time is reduced by the same proportion.

BRIEF DESCRIPTION OF THE DRAWINGS

The invention will be better understood and other advantages procured by it will appear from the following description, given as a non-restrictive example, and made with reference to the appended drawings, of which.

DETAILED DESCRIPTION OF THE INVENTION

Figure 2:
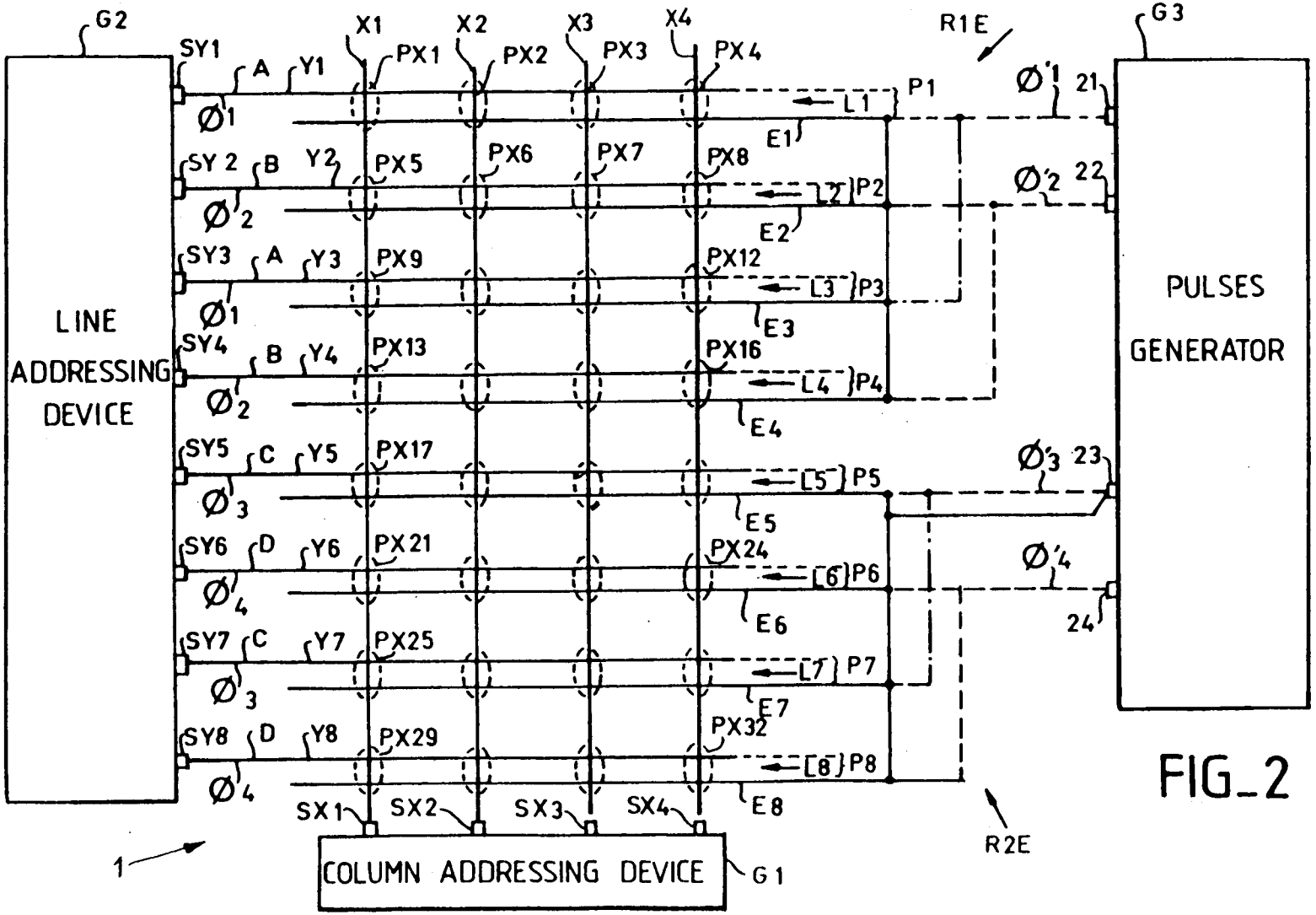
FIG. 2 gives a schematic view of a plasma panel to which the method of the invention may be applied.

FIG. 2 is a schematic drawing of a plasma panel 1 to which the control method according to the invention may be applied. For the greater clarity of the figure, the plasma panel 1 is represented chiefly by conductors or electrodes arranged in columns X1, X2, X3, X4, called column electrodes, and by two classes of conductors or sustaining electrodes, arranged in rows, firstly Y1 to Y8 for the first class and, secondly, E1 to E8 for the second class.

Figure 1:
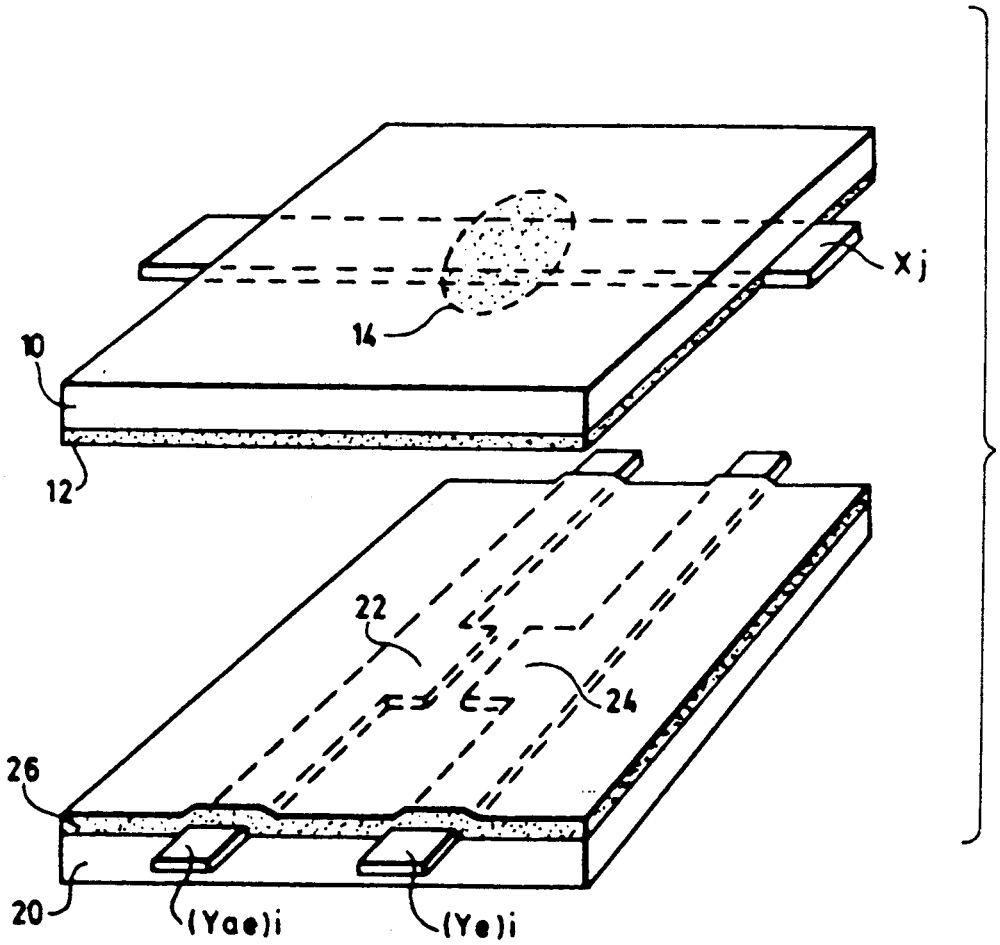
FIG. 1, already described, shows a new type of plasma panel to which the method of the invention can be applied.

Thus sustaining electrodes Y1 to Y8 and E1 to E8 are arranged in pairs, that is, a first electrode Y1 of the first class is associated with a neighboring electrode E1 belonging to the second class, to form a pair P1 of sustaining electrodes. A second electrode Y2 of the first class is associated with a second electrode E2 of the second class to form a second pair P2 of sustaining electrodes. The same is true of the electrodes Y3 and E3, then Y4 and E4, Y5 and E5, Y6 and E6, Y7 and E7, Y8 and E8 which respectively form a third, fourth, fifth, sixth, seventh and eighth pair P3 to P8 of sustaining electrodes. At each intersection of a column electrode X1 to X4 with a pair of electrodes P1 to P8, a picture element or pixel PX1 to PX32 is formed. This picture element or pixel is symbolized in FIG. 2 by a circle drawn with dashes. Each pixel may be formed, for example, according to the structure shown in FIG. 1, and the two electrodes of each pair of electrodes P1 to P8 may or may not have protuberances or projecting parts (not shown in FIG. 2) shown in FIG. 1 with the references 22, 24.

In the non-exhaustive example described, and for the greater clarity of the figure, only 4 column electrodes X1 to X4 and eight sustaining electrodes of each class have been shown, so that only 32 pixels PX1 to PX32 are formed. However, it is clear that the matrix arrangement of pixels may be far greater: it may be formed, for example, by the intersections of 512 column electrodes with 512 pairs of sustaining electrodes, each pair comprising an electrode of the first class Y with an electrode of the second class E.

In a standard way, the column electrodes X1 and X8 fulfill solely an addressing role. They are each individually connected to a different output SX1 to SX4 of a column-addressing device G1. The addressing device delivers voltage pulses which shall be explained in greater detail in a subsequent part of the description, pertaining to FIGS. 3*a* to 3*h*.

The electrodes Y1 to Y8 of the first class are addressing-sustaining electrodes and, consequently, they are also individualized, i.e. they are each connected to a different output SY1 to SY8 of a row-addressing device G2. The row-addressing device G2 delivers sets of voltage pulses which will be explained in greater detail with reference to FIGS. 3*a* to 3*h*.

The electrodes E1 to E8 of the second class E are of the solely sustaining electrode type, and they do not have to be addressed. They are connected to a pulse-generating device G3 which gives second sets of voltage pulses which shall be explained in greater detail in a subsequent part of the description made with reference to FIGS. 3*a* to 3*h*.

The devices G1, G2, G3 are themselves controlled by a central control unit (not shown) which, in a manner known per se, manages the lighting up or extinguishing of the pixels PX1 to PX32 or the function of keeping these pixels PX1 to PX32 lit up or extinguished.

The control method according to the invention is of the type having semi-selective addressing phases and selective addressing phases. In the non-restrictive example described, each semi-selective addressing phase enables the erasure of a whole row L1 to L8 of pixels PX1 to PX32: A row L1 to L8 is a row of pixels formed by the pixels PX1 to PX32 defined by each pair P1 to P8 of sustaining electrodes. Thus, the first row L1 contains the four pixels PX1 to PX4, and corresponds to the pair P1 of sustaining electrodes. The second row L2 contains 4 pixels PX5 to PX8 and corresponds to the second pair P2 of electrodes etc., until the eighth row P8, corresponding to the eighth pair P8 comprising the pixels PX29 to PX32.

According to one characteristic of the invention, a semi-selective addressing is done of at least one row L1 to L8, the second row L2, for example, while the selective addressing of at least another row, the third row L3, for example, is done. This means that in the case where, for example, all the pixels PX5 to PX8 of the second line L2 have been erased in a preceding basic cycle, one or more pixels PX5 to PX8 of this row are written while all the pixels PX9 to PX12 of the third row L3 are erased. A basic cycle period that follows makes it possible, for example, to write one or more of the pixels PX9 to PX12 of the third row L3 while the pixels PX13 to PX16 of the fourth row L4 are erased.

The result of a method such as this is that the time needed for the total control (erasure and writing of two rows of pixels) is divided by two.

In the non-exhaustive example of the description, the simultaneous control of two rows of pixels, one by a semi-selective addressing and the other by a selective addressing, is obtained by applying sets of pulses, which have the same shapes and amplitudes but differ in their phase, to the addressing-sustaining electrodes Y1 to Y4. In the non-exhaustive example described, the signals applied to the addressing-sustaining electrodes are delivered by the addressing device G2 with four different phases 01, 02, 03, 04 but, of course, two phases suffice to obtain a reduction in the image period and, it is also possible to use a greater number.

Thus, the method of the invention consists in achieving the semi-selective erasure of a row L1 to L8 of pixels, independently of the signal present at the column electrodes X1 to X4.

FIGS. 3*a* to 3*h* show diagrams that illustrate a working of the plasma panel 1 which corresponds, for example, to the case where it is sought, successively to erase the sixth pixel PX6 and write the seventh pixel PX7, located on the second row L2. It is observed that the sixth pixel PX6 is located at the intersection between the second pair of electrodes PE2 and the second column electrode X2, and that the seventh pixel PX7 is located at the intersection between the second pair of electrodes PE2 and the third column electrode X3. To simplify this portion of the explanations given with reference to FIGS. 3*a* to 3*h*, it is assumed that the signals applied to the addressing-sustaining electrodes Y1 to Y8 have a same phase.

Figure 3:
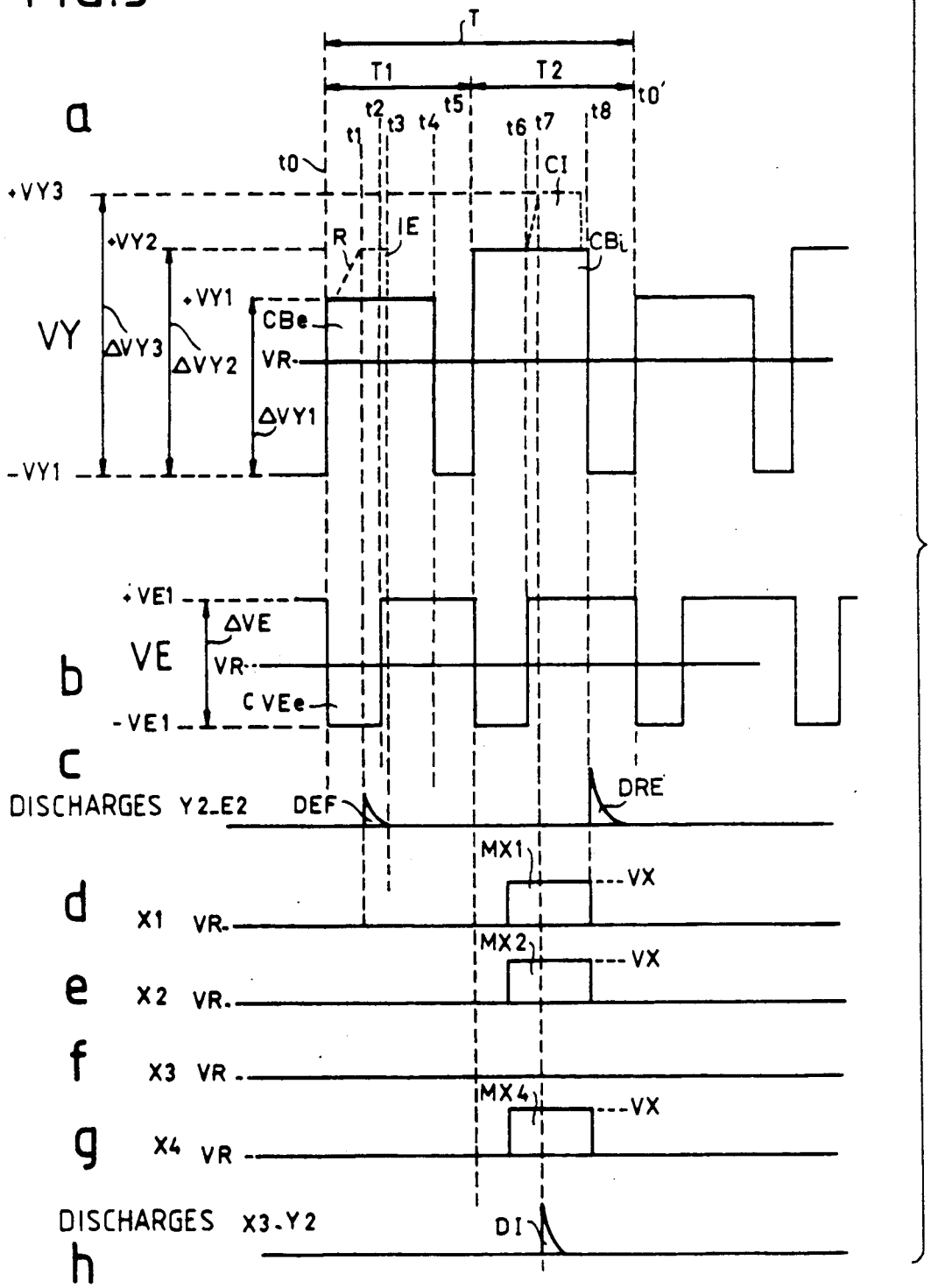
FIGS. 3*a* to 3*h* show signals which explain the working of the plasma panel shown in FIG. 2 and controlled by the method according to the invention.

FIGS. 3*a* to 3*b* respectively show a first set and a second set of cyclical pulses VY, VE which are applied, respectively, to all the addressing-sustaining electrodes Y1 to Y8 and to all the solely sustaining electrodes E1 to E8. FIG. 3*c* illustrates the discharges produced between the electrodes Y2 and E2 of the second pair P2 of electrodes. FIGS. 3*d*, 3*e*, 3*f*, 3*g* respectively show voltage pulses forming masking pulses applied to the column electrodes X1 to X4.

FIG. 3*h* shows a writing discharge DI between the third column electrode X3 and the second electrode Y2.

The first and second sets of voltages VY, VE vary on either side of one and the same reference voltage VR which is at zero volts for example, the column electrodes X1 to X4 also being, at rest, at the potential of the reference voltage VR.

The first and second sets of voltages VY, VE are respectively formed by a first set and a second set of voltage pulses having a cyclical character and a same period T. During this period T, the combination of these voltage pulses develops voltage differences (not shown) between the two electrodes of each pair P1 to P8. These voltage differences determine a phase of erasure T1 (semi-selective addressing) followed by a writing phase (selective addressing) T2.

Before an instant to, when the erasure phase T1 starts, the first and second sets of voltages VY and VE have opposite biases, for example negative and positive biases respectively. At the instant to, these biases get reversed:

- the first voltage VY goes from a value −VY1 to the positive value +VY1. This transition has an amplitude ΔY1. The positive value +VY1 is preserved until the instant t4 when the polarity of the first voltage VY becomes negative.
- the second voltage VE goes from a positive value +VE1 to a negative value −VE1, giving a variation with an amplitude ΔVE which is, for example, smaller than ΔY1. In the non-restrictive example described, the negative value −VE1 is preserved until an instant t2 which precedes the instant t4. At the instant t2, the bias of the second voltage VE gets reversed and becomes positive, marking the end of a negative square pulse CVEe designed to enable the erasure.

At the instant to, the variation in amplitude ΔVY1 of the first voltage VY gets added to the variation ΔVE of the second voltage VE to form the difference in potential applied between the two electrodes of each pair P1 to P8. However, according to a characteristic of the method of the invention, the amplitude of the first variation ΔVY1 of the first voltage VY is not enough for the potential difference thus developed between the two electrodes (the addressing-maintenance electrode Y1 to Y8 and the solely sustaining electrode E1 to E8) of each pair P1 to P8 to cause a discharge between these two electrodes.

The variation ΔY1 of the first voltage VY applied to all the addressing-sustaining electrodes Y1 to Y8 is formed by the front edge of a voltage square pulse established between the instant to and the instant t4. This square pulse, called an erasure base square pulse CBe, is designed to form a voltage base or pedestal or step for an erasure pulse IE.

According to the invention, a voltage pulse, called an erasure pulse IE, IE′ is superimposed solely on the erasure base square pulse CBe applied to the addressing-sustaining electrode Y1 to Y8 that is addressed, i.e. corresponding to the selected pair P1 to P8. In view of the example described, all the addressing-sustaining electrodes receive an erasure base square pulse CBe, but it is only for the second electrode Y2 that an erasure pulse is superimposed on this base square pulse. Consequently, at the second electrode Y2, the first voltage VY reaches a second value VY2 which is greater than the first value VY1.

In superimposing an erasure pulse IE on the erasure base square pulse CBe, we obtain a variation ΔVY2 which is added to the variation ΔVE of the second voltage VE to cause an erasing discharge (FIG. 3*c*) DEF between the two electrodes Y2 and E2 of the selected pair P2. The erasing discharge DEF has a lower intensity than a sustaining discharge and enables cancellation, in a standard way, of the charges (not shown) that have collected between the two electrodes of the second pair P2 at the sixth pixel, in doing so without collecting new charges with reverse bias.

The erasing pulse may have the shape of a square pulse having either a high amplitude and a short duration or a low amplitude and a long duration or, again, it may be formed by a pulse with a rising edge that is set up relatively slowly and forms a slope, as explained in the above-mentioned French patent application No. 78 04893, filed on behalf of THOMSON-CSF and published under No. 2 417 848, which should be considered as forming part of the present description.

In the non-restrictive example described, the erasure pulse IE (shown in dashes), which is superimposed on the erasure base square pulse CBe, is a pulse with a rising edge R that is established relatively slowly as described in the above-mentioned patent, until it reaches substantially the second value VY2.

The erasing discharge DEF occurs at an instant t1 that corresponds substantially to the instant when the erasing pulse IE reaches the second value VY2. In this configuration, all the pixels PX5 to PX8 of the second pair P2 are erased.

Thus, it is noted that a major characteristic of the method of the invention consists in generating a erasing discharge only between the two sustaining electrodes Y2, E2 of one and the same given pair P2, this erasing discharge having the effect of erasing all the pixels that correspond to this pair P2 of electrodes.

It must be noted that, for the pairs of electrodes P1 and P3 to P8, the addressing-sustaining electrode of which receives no erasing pulse IE, the presence of the erasure base square pulse CBE has no effect: all the pixels that are erased stay erased, and all the pixels that are written stay written. That is, the charges (not shown) that existed on the two electrodes of a pair of sustaining electrodes, at the instant to for example, remain.

In the non-restrictive example described, the erasure pulse IE ends at an instant t3 which follows the instant t2 when the bias of the voltage VE of the solely sustaining electrodes becomes positive at the value +VE.

From the instant t4 onwards, the voltage VY has a negative bias until the instant t5 which marks the start of the writing phase T2.

At the instant t5, the biases of the voltages VY and VE get reversed:

the voltage VY, applied to the addressing-sustaining electrodes Y1 to Y8, goes to a positive bias with, directly, the second value VY2, giving a variation ΔVY2 which gets added to the variation ΔVE applied to the solely sustaining electrodes: the result thereof is that, at the instant t5, sustaining discharges (not shown) are generated all the pixels written.

According to another characteristic of the invention, after the erasure of all the pixels of a given pair P1 to P4 of sustaining electrodes, the second pair P2 in the example, the writing of the desired pixels belonging to this pair p2 of electrodes is done in causing a writing discharge between the second addressing-sustaining electrode Y2 and each of the column electrodes X1 to X4, for which the intersection with the second addressing-sustaining electrode Y2 represents a pixel that it is sought to write. Thus, in the case that has been foreseen, namely the writing of the seventh pixel PX7, a writing discharge is made solely between the second addressing-sustaining electrode Y2 and the third column electrode X3.

At the instant t5, the variation in the voltage VY from negative to positive forms the rising edge of a voltage square pulse CBi called a writing base square pulse, applied to all the addressing-sustaining electrodes Y1 to Y8. The writing base square pulse is designed to form a voltage step on which there is superimposed a writing square pulse C1 (shown in dashes). Of course, a writing square pulse C1 is superimposed on the writing base square pulse only for the pair P1 to P8 that is addressed: namely, in the example, for the second pair P2, that is, solely on the writing base square pulse CBi which is applied to the second addressing-sustaining electrode Y2.

Thus, the writing base square pulse CBi also forms a sustaining square pulse for the non-addressed addressing-sustaining electrodes.

The writing square pulse C1, superimposed on the writing base square pulse CBi, reaches a voltage value of +VY3 such that the potential difference VY3−VR, which is then created between the column electrodes X1 to X4 and the second addressing-sustaining electrode Y2, may provoke a triggering discharge or writing discharge, at the intersection between the latter electrode and the column electrodes X1 to X4. Hence, only the desired pixel or pixels are written, in applying a voltage pulse, called a masking pulse MX1 to MX4, with the same bias as the writing square pulse CI. This means that the potential needed to produce a discharge between a column electrode X1 to X4 and the electrode Y2 is achieved solely with the column electrode which preserves the potential VR, namely the one at which no so-called masking pulse is applied. Of course, if a masking pulse is applied to all the column electrodes X1 to X4, none of the pixels is written. In the non-restrictive example described, the column electrodes X1 to X4 are carried to the potential of the reference voltage VR, except during the writing phase T2 when a masking pulse, which carries their voltage to a value VX, may be applied to them.

In the example described, where it is the seventh pixel PX7 that it is sought to write, a masking pulse MX1, MX2, MX4 is applied to the first, second and fourth column electrode X1, X2, X4 for at least the duration of the writing square pulse CI and no masking pulse is applied to the third column electrode X3 (FIGS. 3*d*, 3*e*, 3*f*, 3*g*). The result thereof is that, substantially at an instant t7, there is a writing discharge DI (illustrated in FIG. 3*b*) between the second addressing-maintenance electrode Y2 and the third column electrode X3, at the intersection of these electrodes, namely at the seventh pixel PX7.

It must be noted that the second voltage VE, applied to the solely sustaining electrodes E1 to E8, has a negative bias from the instant t5 to an instant t6 where this bias becomes positive, at the value +VE1. The instant t6 is located a little before the start of the writing square pulse CI or, at any rate, before an instant T7 when the writing square pulse CI reaches the value VY3. The second voltage VE then has the same bias as the first voltage VY applied to the addressing-sustaining electrodes and there then exists, between the second sustaining electrode E2 and the second addressing-sustaining electrode Y2, a potential difference which is not enough to provoke a stray discharge during the superimposition of the writing square pulse CI.

It must be noted that an advantage provided by this arrangement lies in the fact that the masking pulses MX1 to MX4 are produced with a relatively low power, and with a relatively low voltage amplitude, so that standard, low-priced components can be used to control the column electrodes X1 to X4. It is further noted that a particularly important advantage, provided by the method according to the invention, lies in the fact that a single discharge is created between the column electrode X1 to X4, which corresponds to the pixel which it is sought to write, and the pair P1 to P4 of electrodes considered, and in the fact that this discharge occurs solely for the pixels to be written and not for all the pixels of the row. This tends to considerably increase the longevity of the luminophors which are used, as the case may be, for the transmission of light in color.

An indication is given below, purely as a non-restrictive example, of the voltage values which may be used to implement the method according to the invention, with a standard type of plasma panel:

the variations ΔVE of the second voltage VE may be of the order of 100 volts;

for the first voltage VY, the variations ΔVY1 may be of the order of 150 volts, the variations ΔVY2 may be of the order of 80 volts;

the masking pulses applied to the column electrodes X may have an amplitude of the order of 40 volts;

the writing square pulses CI may have an amplitude of the order of 80 volts. Of course, these values are given purely by way of example, and can be easily modified as a function of the characteristics of the plasma panel used.

At the instant t8, the end of the writing base square pulse CBi corresponds to the end of the writing phase T2, and corresponds to a reversal of the bias of the first voltage VY applied to the addressing-sustaining electrodes Y1 to Y8. This bias becomes negative. The second voltage VE applied to the sustaining electrodes E1 to E4 is positive substantially from the instant t6 and, in the non-restrictive example described, it preserves this positive bias until an instant TO' which marks the start of a new cycle of the base T. It must be noted that the writing discharge DI has given rise to the collection of negative charges (not shown) on the dielectric of the second addressing-sustaining electrode Y2 at the seventh pixel PX7. Hence, to the positive-to-negative transition of the first voltage VY, due to the end of the writing square pulse CI and of the writing base square pulse CBi, there is added the effect of the presence of the negative charges that have collected at the electrodes Y2 so that, substantially when the voltage VY reaches the negative value −VY1, a discharge occurs, which forms a resumption of sustaining discharge DRE (FIG. 3c) at the seventh pixel PX7, between the second addressing-sustaining electrode Y2 and the second sustaining electrode E2. Following this resumption of sustaining discharge, charges can again collect, at both electrodes of the second pair P2 at the same time.

It must be noted that the variations ΔVY2 and ΔVE, for example of the voltages VY and VE, applied respectively to the addressing-sustaining electrodes Y1 to Y4 and to the so-called solely sustaining electrodes E1 to E4, have different amplitudes, unlike the usual practice in the prior art. But, of course, these variations in voltages can be adapted to have similar amplitudes. However, with the control method according to the invention, it is worthwhile to have a greater amplitude of the variations in the voltage VY applied to the addressing-sustaining electrodes Y1 to Y4 in order to more easily generate a writing discharge which sufficiently generates charges to facilitate the resumption of sustaining discharge between the addressing-sustaining electrode Y1 to Y8 concerned and the corresponding so-called solely sustaining electrode E1 to E8, without having to bring charges to this electrode E1 to E8.

With the control method according to the invention, the selective addressing phase, that is, in the example, the writing phase, consists in provoking a discharge between the addressing-sustaining electrode Y1 to Y8 of the pair P1 to P8 addressed, and that or those of the concerned column electrodes X1 to X4, i.e. the column electrode or electrodes for which the intersection with the addressed pair represents the pixel to be written. In the example described, a sustaining discharge has been provoked between the second addressing-sustaining electrode Y2 and the third column X3 to write the seventh pixel PX7.

To this effect, the potential difference between the addressing-sustaining electrode which is addressed and only the concerned column electrodes X1 to X4 is increased, through an increase in the first voltage VY applied to the selected addressing-sustaining electrode. Simultaneously, to prevent the writing of pixels other than those selected, a modification is made in the voltage of the other column electrodes that correspond to these other pixels so as to maintain, with respect to these other column electrodes, a potential difference which is not enough to generate discharges. This is obtained by the masking pulses MX1 to MX4.

It is observed, firstly, that the presence of masking pulses MX1 to MX4 is useful only during the writing phase T2 and, more precisely, only when the writing square pulse CI is present (the duration of the latter may vary). It is observed, furthermore, that the presence of a masking pulse MX1 to MX4 does not interfere with the sustaining discharges (which occur between the two electrodes of each pair P1 to P8) and do not interfere with the semi-selective addressing operation, namely the erasure in the example described.

In the non-restrictive example of the description, during a base cycle T, the sustaining discharges of the pixels written occur at the instants t5 and t8 which respectively correspond to the start and end of the writing square pulse CBi, the amplitude of which, represented by the variation ΔVY2, is sufficient to provoke sustaining discharges when they are added to a variation ΔVE of the second voltage VE (it must be noted that the number of sustaining discharges per cycle T could be increased by integrating, in this cycle, a specific sustaining phase such as is formed, for example, by the writing base square pulse CBi which could possibly be interposed between the erasing phase T1 and the writing phase T2).

It is observed that the amplitude of the variations ΔVE of the second voltage VE (applied to the solely sustaining voltages E1 to E8) is smaller than the amplitude ΔVY2 of the first voltage VY, and it is possible to adjust the values of each of these two amplitudes, firstly to cause sustaining discharges when they get added up and, secondly, so that the difference in potential between a solely sustaining electrode E1 to E8 and a column electrode X1 to X4, to which a masking pulse MX1 to MX4 is applied, does not cause any stray discharge between these two electrodes (in also adjusting the amplitude of the masking pulse). It must be noted that this latter point can be obtained also by making the bias of the voltage VE positive before the masking pulse reaches its maximum.

Under these conditions, the application of a masking pulse MX1 to MX4 to a column electrode X1 to X4 has no effect on the instants at which the erasing operations and the sustaining discharges occur. With the method of the invention, this fact is turned to advantage to address two or more rows L1 to L8 or pairs of rows P1 to P8 in parallel during a base cycle, that is, during a period T.

For, if we form the addressing-sustaining electrodes Y1 to Y8 or Y type electrodes in at least one set of two groups (each set being formed by two classes of addressing-sustaining electrodes), one group receives the first sets of pulses (VY) with a first phase $\phi 1$ and the other group receives this same set of pulses (VY) with a second phase $\phi 2$ such that, when the writing phase T2 (selective addressing) is present at the pairs P1 to P8 of sustaining electrodes formed with sustaining-addressing electrodes of the first group, then the erasing phase (semi-selective addressing) is present at the level of the pairs formed with the addressing-sustaining electrodes of the second group, and vice versa.

FIG. 2 shows an exemplary, non-restrictive view of an arrangement of this type, and shows that the addressing electrodes Y1 to Y8 are divided into a first set A-B and a second set C-D, respectively formed by the addressing-sustaining electrodes Y1 to Y4 and Y5 to Y8. The first and third addressing-sustaining electrodes Y1 and Y3 belong to a first group A receiving the pulses with the first phase $\phi 1$, and the second and fourth electrodes Y2 and Y4 belong to the second group B receiving the pulses with the second phase $\phi 2$.

For the second set C-D, the fifth and seventh addressing-sustaining electrodes Y5, Y7 belong to one and the same third group C (which represents the first group of the second set C-D) receiving the pulse with a third phase $\phi 3$. The sixth and eighth electrodes Y6 and Y8 receive the pulses with a fourth phase $\phi 4$.

The solely sustaining electrodes E1 to E8, or E type electrodes, may be formed by one or more networks to which the second sets of pulses are applied with the appropriate phase, namely as a function of the set A-B, C-D and the group to which belongs the addressing-sustaining electrode Y1 to Y8, with which the solely sustaining electrode E1 to E9 is associated.

Thus, for example, the solely sustaining electrodes E1 to E8 may be separated into as many networks as there are addressing-sustaining electrodes Y1 to Y8 so that, for each sustaining pair P1 to P8, the relative phase of the sets of pulses applied to the two electrodes of one and the same pair P1 to P8 is the one shown in the example of FIGS. 3*a* and 3*b*. FIG. 2 illustrates an example such as this by connections, shown in broken lines, connecting the following to the pulse generator G3:

- the first and third solely sustaining electrodes E1, E3 by a first output 21 of the pulse generator G3, delivering the second set of pulses with a phase $\phi'1$.
- the second and fourth electrodes E2, E4 by a second output 22, delivering the pulses with a second phase $\phi'2$.
- the fifth and seventh electrodes E5, E7 by a third output 23, delivering the pulses with a third phase $\phi'4$.
- the sixth and eighth electrodes E6, E8 by a fourth output 24, delivering the pulses with a fourth phase $\phi'4$.

However, a network of solely sustaining electrodes, namely of the type E, may be common to both groups of addressing-sustaining electrodes, namely of the type Y, belonging to one and the same set A-B or C-D. Thus, for example, as shown in solid lines in FIG. 2:

- the first four solely sustaining electrodes E1 to E4 are connected together and connected to the first output 21 of the generating device G3, and form a first network R1E receiving the pulses with the phase $\phi'1$.
- the next four electrodes E5 to E8 are connected to the third output 23, forming a second network R2E receiving the pulses with the phase $\phi'3$.

Figure 4:
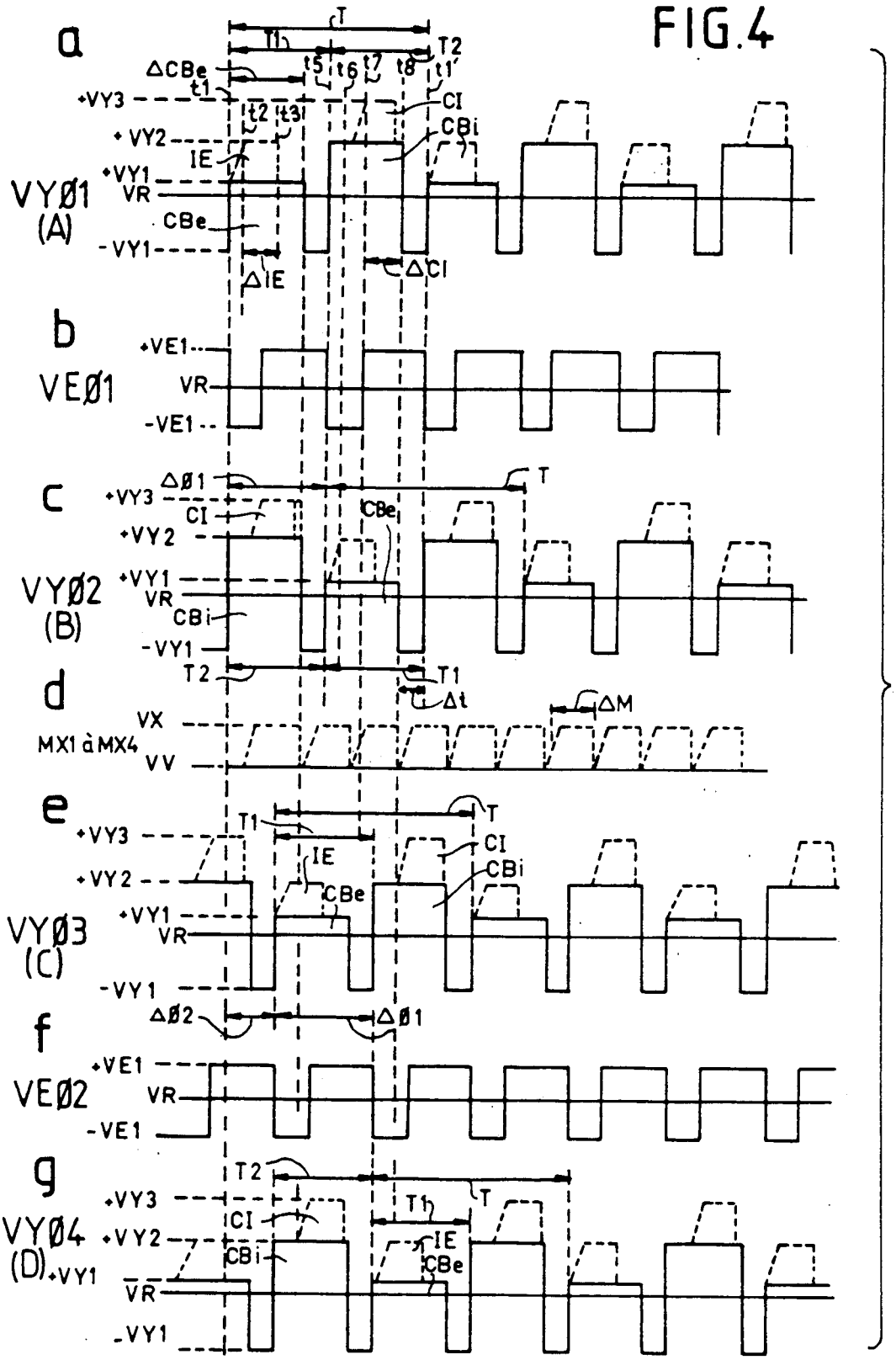
FIGS. 4*a* to 4*g* show signals that give a particular illustration of the simultaneity of the semi-selective and selective addressing.

FIGS. 4*a* to 4*g* illustrate the working which may be obtained with an arrangement such as this FIG. 4*a* shows the first sets of cyclical pulses of the period T, applied with the first phase $\phi1$ to the addressing-sustaining electrodes of a first group A, the electrodes Y1 and Y3 for example. These pulses form the first voltage VY ($\phi1$) already illustrated in FIG. 3*a*. FIG. 4*c* shows the first sets of cyclical pulses VY ($\phi2$) of a period T, applied with the second phase 02 to the addressing-sustaining electrodes Y2, Y4 of the second group B. FIG. 4*b* shows the second sets of cyclical pulses VE ($\phi'1$) applied to the first network R1E of solely sustaining electrodes, with the phase $\phi'1$.

Before an instant t1: the voltage VY$\phi1$ is negative (FIG. 4*a*); the voltage VE$\phi1$ is positive (FIG. 4*b*); the voltage VY$\phi2$ is negative (FIG. 4*c*).

At the instant t1, which marks the start of the base cycle or period T, these biases get reversed:

- the voltage VY$\phi1$ goes to the positive value +VY1 which corresponds to the erasure base square pulse CBE (as already explained with reference to FIG. 3*b*);
- the voltage VE$\phi'1$ goes to a negative value of −VE1 (as already explained with reference to FIG. 3*b*); the voltage VY$\phi2$ goes to a positive value +VY2 corresponding to a writing base square pulse CBi (as already explained with reference to FIG. 3*a*).

It is noted that, between the cyclical voltages VY$\phi1$ and VY$\phi2$, the phase difference $\Delta01$ is such that the erasing phase T1 is created on the pairs comprising the addressing-sustaining electrodes Y1 and Y3 whereas it is the writing phase T2 that is present at the level of the electrodes Y2 and Y4 supplied by the phase $\phi2$.

Under these conditions, the operation is such that, for example:

- the row L1 is erased, if an erasing pulse IE (shown in dashes) is superimposed on the base square pulse CBe applied to the first addressing-sustaining electrode Y1) while the writing is done on the second row L2, if a writing square pulse CI (shown in dashes) is superimposed on the writing base square pulse CBi applied to the second addressing-sustaining electrode Y2, and in applying masking pulses MX1 to MX4 to the column electrodes that are not concerned;
- then, the first row L1 is written while another row L3 etc. is erased.

At present, in view of the components used (i.e. for reasons not related to the principle of the invention), certain durations are incompressible, notably the durations ΔCBe and ΔCBi of the erasure base square pulses CBe and writing base square pulses CBi, each having a duration of 9 microseconds; these two types of square pulses are spaced out by an interval ΔT of the order of 3 microseconds, so that the duration ΔT of a base cycle T or period is of the order of 24 microseconds.

However, with the method of the invention, this duration of a base cycle enables the complete addressing of two rows, that is, 12 microseconds per row in assuming, for example, that the addressing-sustaining electrodes Y1 to Y8 form only one set of two groups A and B.

The working takes place in the same way as in the example illustrated by FIGS. 3*a* to 3*b*, namely:

At the instant t1:

There is no sustaining discharge between the type E electrodes connected to the voltage VE$\phi'1$ and the type Y electrodes connected to the voltage VY$\phi1$.

There may be sustaining discharges (not shown) of the written pixels between the type Y electrodes (addressing-sustaining electrodes) connected to the voltage VY02 and the type E electrodes (solely sustaining electrodes) connected to the voltage VE$\phi'1$.

At the instant t2:

There are erasing discharges (not shown) at all the pixels of a row formed with Y type electrodes connected to the voltage VY$\phi1$ and receiving an erasure pulse IE superimposed on the erasure base square pulse CBe.

At the instant t3:

There is the writing of all the pixels that are formed by means of a Y type electrode connected to the voltage VY$\phi2$ and receiving an writing square pulse CI superimposed on the writing base square pulse (i.e. which is addressed), except for the pixels located on column electrodes X1 to X4, to which masking pulses MX1 to MX4 are applied (shown in FIG. 4*d*).

At the instant t4:

There is a sustaining discharge at the level of all the written pixels formed by means of a type Y electrode connected to the voltage VY$\phi2$; the instant t4 corresponds to the end of the erasure square pulse CBe and to the start of the writing square pulse CBi, respectively applied to the type Y electrodes connected to the voltage VY$\phi1$ and the voltage VY$\phi2$;

At the instant t5 (the instant t5 corresponds to the start of the semi-selective addressing phase for type Y electrodes connected to the voltage VYϕ2, namely to the start of the erasure square pulse CBe, and corresponds to the start of the square pulse CBi for the electrodes Y connected to the voltage VYϕ1):

There is a sustaining discharge at all the written pixels formed with Y type electrode that is connected to the voltage VY01;

At the instant t6:

There is a sustaining discharge at all the pixels of a line formed with a Y type electrode that is connected to the voltage VYϕ1 and receives an erasing pulse IE;

At the instant t7:

There is a writing discharge, and the writing of the pixels of a row formed with a Y type electrode that is connected to the voltage VYϕ1 and receives a writing square pulse CI;

At the instant t8:

There are sustaining discharges at the written pixels formed by means of Y type electrodes connected to the voltage VY01; the instant t8 corresponds to the end of a writing base square pulse CBi for Y type electrodes connected to the voltage VYϕ1, and to the end of the erasure base square pulse CBe for the Y type electrodes connected to the voltage VYϕ2; the end of the base cycle T is at an instant t1' that marks the start of a new base cycle T.

The erasing pulses IE and the writing square pulses CI may have the same duration as that of the square pulses CBe and CBi that support them. However, while being active, these erasing pulses and square pulses IE, CI may have a shorter duration. In particular, the writing square pulses CI may have a shorter duration ΔCI, notably in their active part which is located substantially at their maximum, i.e. towards the voltage VY3. It is thus possible, for example, to give the erasing pulses IE and the writing square pulse a duration ΔIE, ΔCI which is equal to or shorter than 6 microseconds, and likewise for the masking pulses MX1 to MX4, the duration of which may also be equal to or shorter than 6 microseconds.

This makes it easier to use one and the same voltage VEϕ'1 for both groups A, B of Y type electrodes (addressing-sustaining electrodes) of one and the same set. However, this further makes it possible, in combination with other phase shifts of the first voltage VY applied to a second set C-D of type Y electrodes (addressing-sustaining electrodes) to free a portion of time during which the presence of the writing square pulse CI and the masking pulses MX1 to MX4 does not interfere with the operations performed at the rows of pixels formed by the Y type electrodes of the first set A-B, i.e. the electrodes connected to the voltages VYϕ1 and VYϕ2.

This practically makes it possible to perform, in parallel, the full addressing (semi-selective addressing plus selective addressing) of four rows of pixels, thus making it possible to bring the full addressing time per line to 6 microseconds in the non-restrictive example described.

To this end, the Y type or addressing-sustaining electrodes Y5 and Y7 form a third group C belonging to a second set, the other group or fourth group of which is formed by the electrodes Y6 and Y8. Each of these Y type electrodes is associated with a solely sustaining electrode E5 to E8. These four type E electrodes form a second network R2E to which the second set of pulses, forming the second set of cyclical voltages VE, is applied with a phase ϕ'2 different from the one applied to the first network R1E delayed, for example by a phase difference Δϕ2 which is substantially equal to or greater than the duration ΔCI of a writing square pulse CI.

The cyclical voltage set VY is applied to the type Y type electrodes of the third group and of the fourth group D with, respectively, a phase ϕ3 and a phase ϕ4 such that, when the erasure phase T1 is present at the electrodes of the third group C, it is the writing phase T2 that is present at the level of the electrodes of the fourth group, and reciprocally, giving a phase shift Δϕ1 between these two groups equal to a half-period T/2, as between the two groups A and B of the first set A-B. It is noted that, between the voltage VY01 applied to the Y type electrodes of the first group A and the voltage VYϕ3 applied to the type Y electrodes of the third group C, the phase difference Δϕ2 is substantially a quarter period T/4, namely about 6 microseconds in the example described. This phase difference Δϕ'2 also exists between the voltages VEϕ'1 abd VEϕ'2, respectively applied to the E type electrodes of the first network and the second network R1E and R2E (as well as between the second phase and the fourth phase ϕ2, ϕ4).

This description shows that the control method according to the invention enables a considerable increase in the cycle speed, and may be applied to all cases where the semi-selective addressing part is independent of the addressing network, i.e. independent of the network of column electrodes X1 to X4.

It is observed that this is obtained without any technological modification, so that the method described is additional to other approaches (not shown) such as:

- the division of the plasma panel into two halves, for example in the direction of the columns, thus enabling a reduction of the base cycle time by the described;
- a division by 2 of the number of connections of the Y type column electrodes in doubling, for example, the number of column electrodes, in which case the cycle time per row goes, in the example, to 1.5 microseconds.

What is claimed is:

1. A method for the control of a coplanar sustaining AC plasma panel, said panel comprising column electrodes intersecting with two classes of parallel electrodes, the first class of electrodes being formed by addressing-sustaining electrodes and the second class being formed by solely sustaining electrodes, each addressing-sustaining electrode forming, with a neighboring solely sustaining electrode, a pair of sustaining electrodes, each pair of electrodes corresponding to a row of pixels perpendicular to the column electrodes, the pixels being formed substantially at each intersection of a column electrode with a pair of electrodes, said method consisting in the application of first sets of pulses of cyclical voltages to all the addressing-sustaining electrodes and in applying second sets of pulses of cyclical voltages to all the solely sustaining electrodes, the two sets of voltage pulses having a same period within which said pulses of voltages develop, between the electrodes of each pixel, voltage differences which firstly, in a given time interval, create a phase designed for a control of pixels by semi-selective addressing and, in another time interval, generate a second phase designed for a control of pixels by selective addressing and, secondly, generate sustaining discharges, a method wherein, simultaneously, certain pixels are controlled by semi-selective addressing and other pixels are controlled by selective addressing.

2. A control method according to claim 1, wherein the control of pixels by semi-selective addressing is done along the rows of pixels.

3. A control method according to claim 1, wherein the semi-selective addressing achieves an operation for the erasure of the pixels.

4. A control method according to claim 1 wherein, to form a semi-selective addressing phase enabling the erasure of the pixels of at least one given line, said method consists, firstly, in the application to the addressing-sustaining electrodes of a voltage square pulse having a first bias and a first value and, secondly, in the application to the solely sustaining electrodes of a voltage square pulse having a second bias opposite to the first one, so as generate, between these two types of electrodes, a first potential difference which is smaller than a second potential difference that enables sustaining discharges to be obtained between the two electrodes of one and the same pair and, then, in the superimposition of an erasure pulse on the erasure base square pulse which is applied to the addressing-sustaining electrode of the selected row, so as to give rise to erasing discharges solely between the two electrodes of the corresponding pair.

5. A control method according to claim 4 wherein, to form the selective addressing phase enabling the writing of the pixels of at least one row, said method consists, firstly, in the application to the addressing-sustaining electrodes, of a writing base square pulse having a first bias and a second value, and, secondly, in the application, to the solely sustaining electrodes, of the square pulse having the second bias so as to form the second difference in potential capable of generating sustaining discharges, and, then, in the superimposition of a writing square pulse having the same bias solely on a writing base pulse which is applied to an addressing-sustaining electrode corresponding to a selected row so as to generate a third potential difference between the column electrodes and the addressing-sustaining electrode of a selected row and, substantially at the same time, in the application of voltage pulses having the same first bias to all the column electrodes except for those used to define a pixel to be written, said method further consisting in the application, substantially from the instant at which the writing square pulse is superimposed, of a voltage square pulse to the solely sustaining electrodes having said first bias.

6. A control method according to claim 1, consisting in the separation of the addressing-sustaining electrodes into at least two groups to which the first sets of pulses are applied with different phases such that, when the semi-selective addressing phase is present at the addressing-sustaining electrodes of the first group, it is the selective addressing phase that exists at the electrodes of the other group, and vice versa.

7. A control method according to claim 6, wherein the solely sustaining electrodes form a single network common to both groups of addressing-sustaining electrodes.

8. A control method according to claim 6, wherein the addressing-sustaining electrodes are formed in at least two sets, each comprising a first group and a second group to which are applied the first sets of pulses with different phases such that when a first group is in a semi-selective addressing phase, the second corresponding group is in a selective addressing phase and vice versa, and wherein the first sets of pulses are applied to the first groups of each set with a difference in phase that is substantially equal to or greater than the duration of a writing square pulse.

9. A control method according to either of the claims 6 or 8, wherein the solely sustaining electrodes are separated by as many networks as there are groups of addressing-sustaining electrodes, each network of solely sustaining electrodes receiving the second set of pulses with different phases.

10. A control method according to either of the claims 6 or 8, wherein the solely sustaining electrodes are separated by as many networks as there are sets formed with addressing-sustaining electrodes, each network of solely sustaining electrodes receiving the second set of pulses with different phases, each network being common to the two groups of a set.

11. A control method according to claim 1, wherein the selective addressing phase further forms a sustaining phase.

12. A control method according to claim 5, wherein the voltage square pulses applied to the solely sustaining electrodes have an amplitude smaller than the amplitude of the writing base square pulse applied to the addressing-sustaining electrodes.

* * * * *